United States Patent [19]

Nilsson et al.

[11] 4,082,260

[45] Apr. 4, 1978

[54] ADJUSTABLE APPARATUS FOR SEPARATING AN OUTERMOST LABEL FROM A STACK OF LABELS

[75] Inventors: Karl Östen Alf Nilsson, Spanga; Curt Oskar Lindell, Taby, both of Sweden

[73] Assignee: Toolex Alpha AB, Sundbyberg, Sweden

[21] Appl. No.: 725,248

[22] Filed: Sep. 21, 1976

[30] Foreign Application Priority Data

Sep. 24, 1975 Sweden ..... 7510707

[51] Int. Cl.[2] ..... B65H 1/28; B65H 3/22; B65H 3/44

[52] U.S. Cl. ..... 271/1; 156/572; 156/DIG. 30; 271/9; 271/19; 271/24

[58] Field of Search ..... 271/1, 9, 16, 17, 19, 271/20, 21, 22, 23, 24, 25; 156/572, 571, 570, DIG. 31, DIG. 30, DIG. 29

[56] References Cited

U.S. PATENT DOCUMENTS

| | | | |
|---|---|---|---|
| 1,485,344 | 2/1924 | Fenn | 156/DIG. 29 |
| 2,907,556 | 10/1959 | Giffen | 271/19 |
| 3,749,396 | 7/1973 | Pierre | 271/9 X |
| 3,785,637 | 1/1974 | van der Does | 271/24 |
| 3,809,388 | 5/1974 | Downing | 271/20 |
| 3,822,024 | 7/1974 | Endter et al. | 271/20 X |

*Primary Examiner*—Bruce H. Stoner, Jr.
*Attorney, Agent, or Firm*—Stevens, Davis, Miller & Mosher

[57] ABSTRACT

An apparatus is provided for separating a single outermost label from a stack of labels mounted on a centrally disposed shaft in a magazine. The apparatus utilizes a pair of friction members diametricaly opposed from said shaft and containing respective friction engaging elements which are caused to reciprocally move into a position where the friction engaging elements doggingly engage the outermost label of the stack and move toward one another thereby causing the outermost label to slide and bend outward from the next adjacent label in the stack. Included in the apparatus is an adjustable camming mechanism for varing the points at which the friction engaging elements contact the outermost label of the stack.

12 Claims, 3 Drawing Figures

ADJUSTABLE APPARATUS FOR SEPARATING AN OUTERMOST LABEL FROM A STACK OF LABELS

BACKGROUND OF THE INVENTION

The present invention relates to a method for the separation of phonograph record labels in an automatic, repeated operation, from a stack of phonograph record labels provided with center holes and stacked on a centering pin. The method involves bringing the successively outermost label, as considered in the feed-out direction, out of adhesive engagement with the adjacent label in the stack and presenting the outermost label in a preparatory position for being picked off from the stack. After pickoff the outermost label is conveyed to and delivered at a label-receiving station by means of a conveying means provided with suction means.

Previously, when separating a pliant sheet-like article from a stack of such articles and bringing said article into a position in which it is ready for separate transport to a working station where the article is applied to an intended surface the article has been removed from the stack by means of a collecting device which is brought into direct contact with the article lying outermost at the end of the stack. A disadvantage with such collecting or pick up devices is that, at least in the case of certain types of pliant sheet-like articles, it is difficult to prevent more than one article at a time from accompanying said device, thereby causing a high degree of wastage and uneconomical stoppages in production.

Particularly with respect to labels intended for phonograph records, the labels have hitherto been carried from a stack of such labels to a labelling station by means of one or more suction cups connected to a vacuum source, said suction cups being urged against the outermost label in the stack and then moved to said labelling station while maintaining a suction force in said cups. It is essential that the cups exert only that suction force required to remove a single label at a time from the stack of labels. If the suction force is excessively high then two or more labels may be removed at a time from the stack of labels, while on the other hand if the suction is excessively low then the label is liable to fall from the cup or the cup may fail to pick up a label from the stack. The percentage of phonograph records which must be rejected owing to the fact that a label has not been correctly applied thereto when using such suction cups is relatively high. As a result faulty labelling constitutes the major cause for rejection of phonograph records in the manufacture thereof using fully automatic apparatus.

It is also previously known, e.g. through the German patent specification No. 1,779,967, to suck out phonograph record labels from a stack of labels through a circular feed-out opening having a limiting surface which converges in the feed-out direction and which, as viewed in section, presents a toothed profile. The purpose of this construction is that the labels shall be urged to drag with their peripheral edges over the circular ridges thus formed in said profiled limiting surface in order to be shaken apart before being finally fed out. In practice, however, this method does not constitute any beneficial solution of the problem since the labels frequently have a tendency to adhere to each other at different places of the abutting surface, which consequently results in considerable incalculabilities in operation.

SUMMARY OF THE INVENTION

Therefore, an object of the invention is to provide a method and apparatus by means of which a pliant sheet-like article, preferably a phonograph-record label can be removed singly from stack of such articles in a more positive manner than was herein-before possible, and to facilitate removal of each separated article in an unlimited sequence.

In accordance herewith, the method according to the invention is mainly characterized by the following steps; urging two friction members against the free outer surface of said outermost label in said stack, the friction members arranged one on either side of the centering pin substantially diametrically opposite to each other with their friction engaging elements in dogging engagement with said free surface of said outermost label and, while maintaining said dogging engagement with said label, positively moving the friction engaging elements of the friction members toward one another in the substantially original plane of said outermost label in said stack from either side of the centering pin so that said outermost label while sliding against said adjacent label is urged out of any existing adhesive or sticking engagement with said adjacent label and caused to arch in the feed out direction symmetrically in relation to the centering pin a required amount and into final position for separation, picking off and conveying the outermost label from said stack and causing the friction members with their friction-engaging elements to return to a retracted resting position preparatory to commencing the next label-separating operation, this described operation being carried out in an unlimited sequence.

The invention also relates to an apparatus for carrying into practice the method according to the invention in the separation of phonograph record labels in an automatic, repeated operation, from a stack of phonograph record labels provided with center holes and stacked on a centering pin. The apparatus brings the successively outermost label, as counted in the feed-out direction of said labels, out of adhesive engagement with the adjacent label in said stack and presents said outermost label in a preparatory position at which it is picked off from the stack, conveyed to and delivered at a label-receiving station by means of conveying means provided with suction means.

The apparatus according to the invention is mainly characterized in comprising, at least one label magazine open at its feed-out end through which extends a centering pin secured to the bottom of said magazine for receiving a stack of phonograph record labels piled thereon inside the magazine, two friction members arranged in front of the open end of the magazine provided with friction engaging elements located one on either side of the axis of the centering pin substantially diametrically opposite to each other in relation to the axis of the centering pin, said friction members being positively movable from a retracted resting position into a dogging engagement of their friction engaging elements with the free surface of the outermost label in the magazine, and a mechanism for moving the two friction members toward each other in the substantially original plane in the stack of said outermost label while maintaining said dogging engagement in order to insure that the outermost label while sliding against the adjacent label in the stack is urged out of any existing adhesive or sticking engagement with said adjacent label and caused to arch in the feed out direction symmetrically in relation to the centering pin a required amount and into a final position for separation, picking off and conveyance from said stack respectively, the friction members with their friction engaging elements being retractable into the resting position preparatory to recommencing the label-separating operation.

BRIEF DESCRIPTION OF THE DRAWINGS

An exemplary embodiment of the invention will now be described in detail with reference to the accompanying schematic drawings, in which.

DETAILED DESCRIPTION

The illustrated apparatus comprises a frame structure having two posts 10 and 11 of circular cross section. The posts 10 and 11 are connected at each end thereof by means of connecting members 12 and 13 respectively, both of said members resting against abutment surfaces (not shown) and being tightened to said surfaces by means of nuts 14 and 15 respectively.

Figure 2:
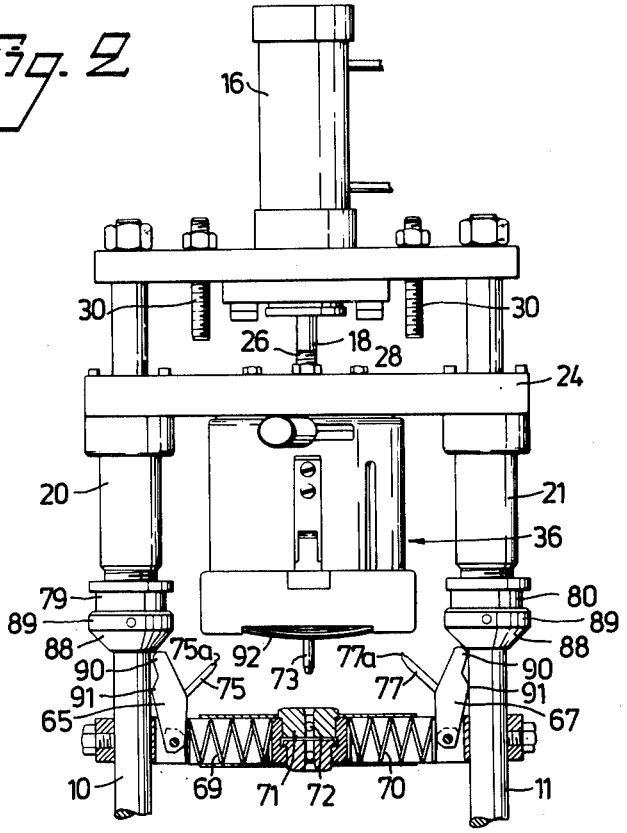
FIG. 2 is a sectional view of the upper portion of the apparatus shown in FIG. 1, the elements thereof being shown in their starting position for a label-separating operation.
Figure 3:
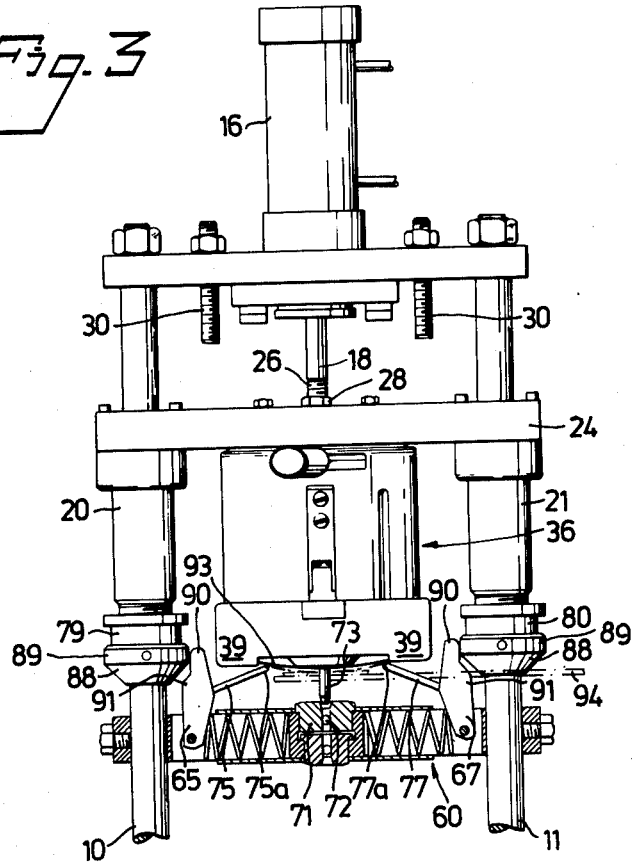
FIG. 3 is a view of the same portion of the apparatus shown in FIG. 2 but with said elements in a terminal stage of said label-separating operation.

The connecting members 12 and 13 each support centrally a respective piston-cylinder arrangement 16 and 17 having arranged therein a double-acting piston which is operable by means of a pressure medium, such as pressurized gas or liquid. The piston rods of the pistons project from the pressure cylinder 16 and 17 respectively with the ends of said pistons facing each other (only upper piston rod 18 is shown in FIGS. 2 and 3).

Arranged on respective posts 10 and 11, at either end of the frame, are slide sleeves 20, 21, 22 and 23, the sleeves 20 and 21 being joined to each other by means of a connecting member 24 and the sleeves 22 and 23 being joined to each other by means of a connecting member 25. The connecting members 24 and 25 with the sleeves 20, 21 and 22, 23 form slide assemblies which are displaceably mounted on the posts 10 and 11, said posts serving as guide means for movement of the two slide assemblies 24, 20, 21 and 25, 22, 23 towards and away from each other during operation of the apparatus, this movement being effected through the piston rods 18. To this end, each of said piston rods is connected to a respective connecting member 24, 25 by means of respective pin bolts 26, 27 screwed into the ends of the piston rods. Each piston rod is locked in its adjusted position by means of a respective locking nut 28, 29.

Extending through the two connecting members 12 and 13 of the frame structure of the apparatus are stop screws 30 and 31 respectively, said screws being provided with respective locking nuts 32, 33. As will be seen from FIG. 1, the stop screws 30 and 31 limit the extent to which the slidable connecting members 24 and 25 can move away from each other when adopting their predetermined starting or inoperative positions.

Label magazines generally indicated by arrows 36 and 37, respectively, are secured on the mutually opposing sides 34 and 35 of the two slidable connecting members 24 and 25 in a manner such as to be readily removable from said sides, each of said magazines being arranged to receive a stack of circular sheets or labels having a hole arranged centrally therein and being of the type suitable for labelling phonograph records or blanks therefor. The magazines 36 and 37 are assumed to be of identical construction and, as shown by the magazine 37 shown partly in broken view at the bottom of FIG. 1, comprise a container 38 of circular cross section, having an open end over which is arranged a ring-shaped closing member 40. The member 40 forms a cap for the magazine and has a few substantially diametrically opposed stop and support flanges 39, extending from the inner periphery of said member 40. The closing ring of member 40 is readily removable from its respective container 38 so as, inter alia, to enable the container to be filled with fresh labels or emptied of unused labels and, furthermore, is readily lockable to said container 31, for example, by means of quick-locking or clamping means of any suitable type. In the drawing one such means is shown to have the form of a stirrup-shaped, spring hasp 41 arranged on the outer surface of the container 38 of the magazine 36 in FIG. 1, said hasp being arranged to cooperate in a known locking manner with a fixed shoulder 42 or the like on the closing ring 40. Normally, at least two such securing means 41 are required, in which case they are suitably placed diametral to each other on the outer surface of the container 38 so as to retain the closing ring 40 with its support and stop members 39 in the correct position for smooth feed of the labels one at a time from respective magazines 36 and 37 through a feed opening arranged at the free end thereof.

Figure 1:
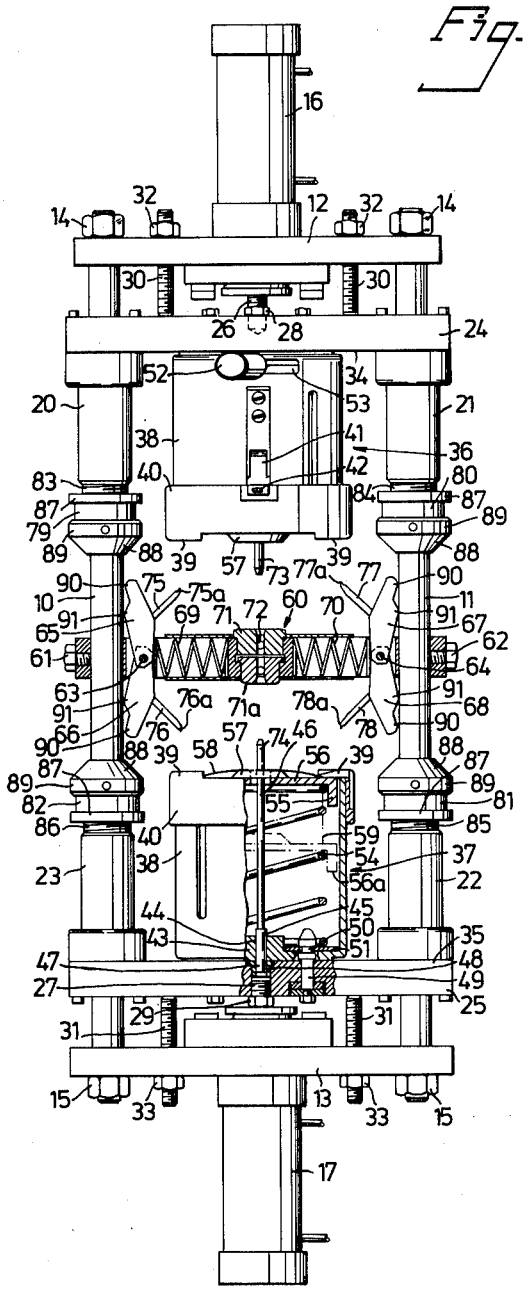
FIG. 1 is a front view of an exemplary apparatus according to the invention, which is constructed so as to simultaneously remove one label at a time from each of two separate stacks of labels.

As will be seen particularly from the magazine 37 shown at the bottom of FIG. 1, the bottom surface of the container 38 contains internally a central bead 43. A bore 44 extends centrally through the bottom of the container 38 and also through the bead 43, which accommodates a thickened end 45 of a stacking or centering pin 46, said pin 46 being substantially centrally arranged in the magazine 37 and being intended to receive the perforated circular labels, said thicker end 45 being fixed in said bore in a manner such that it projects slightly outside the bottom of the container. This outwardly projecting portion, which is referenced 47, of the said thickened end 45 is operable as a centering pin for the magazine 37 and is accomodated loosely in a seating 48 arranged centrally of the connecting member 25.

The magazine 37 is secured to the connecting member 25 in a manner so as to be readily removed therefrom, by means of a number of locking pins 49 (only one of which is shown) which pass through the connecting member 25 and through the bottom of the container in a predetermined distribution and on the same radius. The illustrated locking pin exhibits an annular locking groove 50 which, in the position of the magazine 37 shown in FIG. 1, cooperates with a locking plate 51 capable of being rotated around the bead 43 by means of a handle 52 which extends through an elongate opening 53. In the illustrated embodiment, the locking plate is assumed to have through passing key-hole like openings, through which each locking pin 49 may be passed, the wider portion of each said openings being brought, by rotating the locking plate 51 about the bead 43 by means of the handle 52, to a position such that the locking pins may pass unhindered through said openings to adopt a position in which they are ready for locking or releasing the magazine. When the magazine shall be mounted in position, the locking plate is rotated in a direction such that the narrow portion of each keyhole-like opening engages the locking groove 50 of its respective locking pin 49 and thus fixes the magazine in the apparatus. The described quick-locking arrangement comprises a known arrangement and does not therefore constitute a characterizing feature of the present invention, but shall only be considered an example of convenient quick-connecting arrangements suitable for use with the presently described label magazines.

With continued reference to the broken view of the magazine 37 at the bottom of FIG. 1, it will be seen that arranged concentrically in the container 38 is a helical pressure spring 54, one end of which rests against the bottom of the container, via the locking plate 51 as shown in FIG. 1, while the other end abuts with and supports a circular support plate 56 upon which labels stored in the magazine are stacked, said plate 56 being provided with a peripherally extending ring-shaped guide flange 55. The stacking or centering pin 46 is arranged to pass centrally and freely through the support plate, and the label-supporting surface of the plate may be completely planar, although in the illustrated preferred embodiment a circular bead 57 is arranged centrally of said plate. In accordance with the method of the invention the bead 57 is operable to arch or to bend each label in the stack of labels at least slightly outwardly in the outfeed direction of said labels in preparation for a label-separating operation, such that the successively outermost label, at or before each actual label-separating operation, has a tendency to bulge slightly outwardly in the outfeed direction of the labels. More specifically, the bead 57 arches the labels so that said labels deviate from the basic plane, i.e., the plane of a flat label. By way of explanation, there is shown at the bottom of FIG. 1 in the upper portion of the magazine the last label 58 of a consumed stack of labels, said label 58 being shown in such a preparatory, slightly outwardly arched position. It will be noted that the label is held with a weak clamping force between the diametrically opposed support and stop flanges 39 and the support plate 56 which is biassed by the spring 54.

For explaining the mutual positions of the details more closely, dotted lines 59 and **56*a* represent, respectively, an unconsumed portion of a stack of labels and the position of the pressed-in support plate 56 supporting the unconsumed stack. It is obvious that the spring 54 is kept in said pressed-in position by said plate 56 pressing against the unconsumed portion 59** of the stack of labels.

Extending between the two posts 10 and 11 and located centrally between the two magazines 36 and 37 is a partially hollow connecting means which is generally denoted by the arrow 60 and which is mounted with its ends on the two posts or guides 10 and 11 and affixed thereto by means of screws 61 and 62. Pivotally mounted at each end of said connecting means about an axis 63 and 64, respectively, is a pair of cam followers 65, 66 and 67, 68, respectively, which are normally biassed to the retracted inoperative resting position shown in FIG. 1 by a respective pressure spring 69 and 70 guided in the hollow interior of said connecting means. The forces of these springs, as a result of the manner in which they are mounted, are equally distributed on the cam followers of each said pair of cam followers.

Attached centrally of the arm 60 and extending therethrough is a bushing means comprising two coaxial mounted loose members 71 and **71*a* containing through passing guide hole 72 for receiving the ends 73 and 74 of the centering or stacking pins projecting outwardly of the magazines 36 and 37, said ends 73 and 74 having a chamfered point to facilitate guiding of said pins into the holes 72 through the widened openings thereof so as to adopt a centered position. The two loose members 71 and 71*a*** of the bushing device are mutually adjustable transversely and can be fixed in the positions to which they are adjusted.

Attached to each cam follower 65, 66, 67, and 68 is a respective friction member 75, 76, 77 and 78, the free end of which has the form of a sharp edge, point, or the like. Free ends **75*a*, 76*a*, 77*a* and 78*a* respectively form a friction engaging element for engagement with the outermost label in each magazine 36 and 37 during each label separating operation. The friction engaging elements 75*a*–78*a*** are suitably made of steel, although other materials having good friction characteristics and permanence to wear may be used as an alternative, e.g., rubber, plastics etc. .

Each of said cam followers 65, 66, 67 and 68 is arranged to co-operate with a respective camming device 79, 80, 81 and 82. In the illustrated embodiment these camming devices each comprise a sleeve which is displaceably mounted on the posts 10 and 11 and screwed onto the outer ends of the slide sleeves 20, 21, 22 and 23, the ends of which are provided with respective screw-threads 83, 84, 85 and 86. Thus, the arrangement is such that the camming devices are separately adjustable on said screw-threads and are capable of being fixed in adjusted positions by means of locking nuts 87. Further, the camming devices accompany the magazines 36 and 37 during their translatory movements on the guides 10 and 11 in accurately adjusted positions.

Each of said camming devices 79–82 exhibits two camming surfaces, namely a conical end surface 88 and a cylindrical surface 89 contiguous therewith. Each of the cam followers 65–68 is provided with a cam-detecting portion 90 arranged to follow the cam surfaces when the camming devices move into engagement therewith during a label-separating operation.

As will be seen from the drawing, each cam follower 65–68 has a further cam detecting portion 91. This further detecting portion 91 is, in principle, intended to be used when it is preferred to control the operating movement of the friction members 75–78 solely from the camming devices 79–82 actuating the cam followers 65–68. Normally, the operating movement of the friction members will be controlled by a combination of a camming actuation of follower portions 90 of the friction members and a direct transmission of movement thereto from the magazine or from the stack of labels contained therein. In conjunction with what has been indicated above concerning the guiding of the operating movements of the friction members solely by a camming action, it must be emphasized that, in such cases, the camming devices 79–82 should be unscrewed on the slide sleeves to such a degree and fixed thereon in such a position that the camming devices during the operation of the apparatus will engage the cam detecting portions 91 alternatively at the same time as or only shortly after the friction engaging elements of the friction members have doggingly engaged the outermost labels in the magazines. The extent to which the movements of the friction members are guided by camming action in conjunction with a direct transfer of movement from the magazines or stacks of labels can naturally be varied within the scope of the invention in functionally possible proportions between transmission and direct transfer of movements.

The apparatus illustrated in FIG. 1 is specially chosen within the scope of the invention as an example of a twin-type arrangement, by means of which it is possible to remove labels one at a time from two opposed stacks of pliant labels contained in two different magazines 36 and 37 and to carry said labels singly to a pick up position for further transport to a common label-applying station located externally of or adjacent the apparatus.

Such an apparatus is well suited for applying labels to blanks from which phonograph records are to be made, preferably in conjunction with structures for forming discs from said blanks.

As will be immediately clear from FIG. 1, the magazine of the apparatus and elements associated with said magazine are arranged symmetrically in relation to the connecting number 60, which also means that the upper and the lower magazine units shown in FIG. 1 operate in mutually the same manner although in different directions. Consequently, hereinafter the method and the apparatus together with its mode of operation in accordance with the invention will be described solely with reference to the upper portion of said apparatus including the magazine 36 in FIG. 1, it being assumed that said description, apart from differences in reference numerals, will also apply to the lower portion of the apparatus.

In FIGS. 2 and 3, which show the upper portion of the apparatus in two different stages of a label-separating operation, the elements forming part of said upper apparatus portion are identified with the same references as the corresponding elements in FIG. 1.

With reference first to FIG. 2, the connecting member 24, the slide sleeves 20 and 21, the camming devices 79 and 80 and the magazine 36 are shown during their movement downwards under the action of the piston of the piston-cylinder arrangement 16, this downward movement being apparent by the fact that the connecting member 24 has moved away from the stop screws 30. The camming devices 79 and 80 are shown as occupying positions in which the conical camming surfaces 88 thereof are in contact with the cam detecting portions 90 on the cam followers 65 and 67, wherein the further cam detecting portions 91, which are normally held yieldingly biassed against the guides 10 and 11, respectively, by means of springs 69 and 70, are about ready to leave said guides because the conical camming surfaces 88 cause, via the cam detecting portions 90, the cam followers 65 and 67 to rotate clockwise and anticlockwise, respectively, around their respective axes 63 and 64. Upon continued downward movement of the camming devices 79 and 80, the cam followers will be pivoted further inwardly towards the center of the apparatus, wherewith the friction members together with the aforedescribed edges or points **75*a* and 77*a* operable as friction engaging elements will be swung into the path of movement of the outermost label, here referenced 92, located in and accompanying the magazine 36 so that said friction engaging elements will abut said label in a dogging engagement therewith. As will be seen from FIG. 2, the label 92 and the labels located therebehind in the magazine are slightly arched in the outfeed direction of the labels, although shown in an exaggerated way in FIG. 2, by the pressing of the centrally arranged bead 57 of the internal support plate against the inner end of the stack of labels in accordance with what has been hereinbefore explained with reference to FIG. 1. In this way, the successively outermost label of the stack of labels in the magazine has, at all times, at least a slight tendency to deviate from its basic starting plane (as hereinbefore defined) in the stack before an actual label-separating operation commences; label separation occurring with the aid of the friction members 75 and 77 and their friction engaging elements 75*a* and 77*a*. As an alternative to this method of arching the labels it is possible, in accordance with the invention to provide all labels in advance with a tendency to bend out in this way. If this is done the central bead 43** may be omitted.

The manner in which the apparatus separates a single label from the stack of labels will now be described with reference to FIG. 3.

In FIG. 3, there is illustrated a situation in which the cam detector portions 90 of the cam followers 65 and 67 have just terminated their cam detecting movements against the passing conical camming surfaces 88 and have arrived at the terminal position for camming actuation in abutment with the cylindrical camming surfaces 89. In conjunction therewith, the friction members 75 and 77 have been pivoted further into the path of movement of the last label 93 of the stack, as shown in FIG. 3, (the other labels of said stack having been consumed), the points **75*a* and 77*a* of said friction members at least being brought into a preparatory position for a subsequent dogging engagement with said last label. Prior to this, the end 73 of the stacking pin projecting from the magazine 36 has been guided into and centered in the hole 72 in the central bushing means 71 in the connecting member 60. The magazine 36 and those elements accompanying the movement thereof continue their movement in a direction towards said member 60. At this point responsibility for the movement of the friction members 75 and 77 is taken by the magazine 36 from the camming devices 79 and 80, which results in the cam followers 65 and 67 being pivoted substantially free from the camming devices whilst the friction members 75 and 77, due to the dogging engagement of the friction engaging elements with the label 93, continue to pivot as a result of the influence exerted by the magazine 36 or the stack of labels therein. At this stage the points 75*a* and 77*a* of respective friction members 75 and 77 approach each other which forces the label 93 to further curve outwardly from its basic plane in the magazine. In this way, opposed peripheral portions of the label are moved out of engagement with the flanges or lips 39 of the support and stop ring 40 and leave the magazine through its feed out opening in a centered position on the end of the stacking pin 73 protruding from the magazine. This position can be considered the leaving or discharge position of the labels separated from the stack by the apparatus. The same position of the label, however, furthermore constitutes a preparatory position for picking up and conveying said label to a station in which, for example, it is applied to a blank. Such transport of the label may, for example, be effected by means of known conveying devices, such as arms having suction cups arranged thereon which hold by suction each separated label in a centered position, the arms functioning to swing the label away from the collecting position once the end of the stacking pin 73 has been removed from the hole in the label during the return movement of the magazine 36 to its starting position against the stop screws 30**. One such known label collecting device provided with suction cups is indicated in FIG. 3 with chain lines and generally denoted 94.

In the aforegiven description, the normally preferred alternative of the method according to the invention and the mode of operation of the apparatus for carrying out said method has been given, primarily, with reference to FIG. 3, illustrating that the friction members are capable of being guided into dogging engagement with the outermost label of a stack and that the same friction members, while maintaining said engagement, are capable of being swung further towards each other solely by movement of the stack of labels in the oncoming magazine, thereby forcing the label to slide in its substantially original or basic starting plane in the stack which causes the central portions of said label to deviate from said starting plane and from the next adjacent label in the stack or, when said label is the last label of said stack, from said support plate.

Due to the fact, however, that the camming devices 89 are capable of being screwed to different positions on the slide sleeves 20 and 21, there is afforded the possibility of distributing the transmission of movement from the magazine and the camming devices to the friction members 75 and 76 in a manner such that the cam guide mechanism causes not only the friction members to be brought into dogging engagement with the label, but also a first portion of the continued pivotal movement of said friction member towards each other such as to cause the label to bend outwardly before the magazine 36, or more specifically the stack of labels, takes over responsibility for the continued movement of the friction members. This can readily be achieved by screwing back the cam members 79 and 80 on respective sleeves 20 and 21 in a manner such that the cam surfaces 88 come into contact with the detecting portions 90 of the cam followers at a point of time which is somewhat later than that when the cam members 79 and 80 adopt the adjustment positions on the slide sleeves 20 and 21 illustrated in FIGS. 2 and 3.

Finally, the apparatus according to the invention affords still another alternative, namely that a label-separating operation can be effected substantially solely by the camming action. To this end, each cam follower 65 and 67 is provided with the further cam detecting portion 91, intended to assume the responsibility of pivoting the cam followers 65 and 67 and therewith the friction members 75 and 77 further towards each other once the cam detecting portions 90 have been reached by the cylindrical cam surfaces 89. Thereafter, the cam detecting portions 91 come, instead, in contact with the conical camming surfaces 88 and transmit continued pivoting movement to the friction members 75 and 77 so that said members effect substantially the complete separating operation solely through the cam guide mechanism. In order to utilize this alternative, the position of the camming devices 89 and 90 is adjusted by screwing them forwardly on the slide sleeves so that the cam surfaces 88 thereof contact the detecting portions of the cam followers at a point of time earlier than that intended with the positions shown in FIGS. 2 and 3. Whichever alternative is selected, however, it is essential that the camming devices 79 and 80 are precisely positioned relative to the slide sleeves 20 and 21.

Generally expressed, the apparatus according to the invention enables the transfer of movement to the friction members to occur arbitrarily in various proportions between transmission and direct actuation. In view of the fact that the labels forming the stack often stick together or tend to adhere to one another, it is normally necessary, or at least desirable, in order to achieve consistently, positive separation of one label at a time from said stack during each operation, to prevent the stack of labels from becoming obliquely positioned in the magazine or displaced laterally when the friction members with their friction elements in dogging engagement with the outermost label move in the basic starting plane in the magazine. More specifically, it is intended that the stack of labels shall be supported by means of suitable reaction members which are arranged to hold the stack in the intended correct position, despite the force applied to the outermost label by the friction engaging elements of said friction members.

As will be best seen from FIG. 3 in the illustrated embodiment of the apparatus according to the invention, the problem of providing such a reaction or support means has been solved in a particularly simple and advantageous manner. Since the invention is concerned with the handling of perforated labels which are to be applied to phonograph records or blanks therefore, the complete stack of labels is placed on the stacking pin 46 which, during each separating operation, is supported in a centered position in the opening 72 in the bushing device 71, thereby providing the requisite reaction means.

On the other hand, the apparatus comprises two friction members provided with friction engaging elements, namely members 75 and 77, which operate in opposite directions to each other and therefore mutually form reaction means for the forces exerted therebetween, which forces are therefore equilized without being able to influence the position of the stack such as to displace the same.

Although the invention has been described above with reference to an embodiment thereof having coordinated pairs of label magazines operating in mutually opposite directions it is also within the scope of the invention to use a single label magazine with associated means for separating the labels in the described way.

The invention is not restricted to the illustrated and described embodiment thereof, but can be modified within the scope of the accompanying claims.

We claim:

1. An apparatus for separating articles one by one from a stack of articles in a repeated operation comprising:

a magazine housing said stack of articles, said magazine containing a supporting plate acting on one end of said stack of articles, a resilient means for urging said supporting plate toward an open end of said magazine, and a retaining means mounted on said open end for retaining said stack of articles in said magazine against the force of said resilient means, said retaining means having a shape which allows access to the surface of the outermost article in said stack, a pair of frictional members containing respective article engaging elements, said frictional members symmetrically located on either side of the central axis of said magazine, and being mounted on respective cam followers which are pivotally mounted and biased to keep said article engaging elements retracted away from said magazine, a pair of cam surfaces for engagement with respective cam followers, said cam surfaces causing said cam followers when engaged therewith to move said article engaging elements against said bias toward the outermost article of said stack, means for reciprocally moving said magazine relative to said article engaging elements including means causing said cam followers to move into engagement with said cam surfaces to thereby produce a movement of said article engaging elements into dogging contact with the outermost article of said stack, and for causing said engaging elements to move toward each other while they are in dogging contact with said outermost article to thereby slide said outermost article with respect to the next adjacent article in said stack and to bulge said outermost article away from said next adjacent article, and a cam positioning means for adjusting the distance which must be traveled by said cam followers before engaging the respective cam surfaces during said relative movement.

2. An apparatus as in claim 1 wherein said supporting plate has mounted therein in a centrally disposed position a protruding bead for imparting a slight arch to said stacked articles.

3. An apparatus as in claim 1 wherein each of said cam followers contains a first and second cam abutting surface, said first cam abutting surface positioned to engage a respective cam surface to cause during said relative movement an initial movement of a respective article engaging element into said dogging engagement with said outermost article and to further cause said sliding and bulging movements of said outermost article solely by action of said first cam abutting surface engaging said respective cam surface, said second cam abutting surface positioned for engagement with said respective cam surface during said relative movement only after said first cam abutting surface first engages said respective cam surface to cause said initial movement, said second cam abutting surface positioned to cause, after said initial movement of said article engaging elements, the sliding and bulging of said outermost label by action of said second cam abutting surface contacting said respective cam surface and the relative movement of said magazine toward said article engaging elements, said cam positioning means being capable of being adjusted such that either said first or both said first and said second cam abutting surfaces engage said respective cam surface during said relative movement.

4. An apparatus as in claim 1 wherein said magazine is detachably mounted within said apparatus.

5. An apparatus for separating centrally apertured phonograph record labels one by one in a repeated operation, from a stack of said labels, comprising:

a spindle for receiving said stack of labels threaded thereon;

a label magazine housing said spindle which projects outwardly of the magazine, said stack of labels threaded thereon, a resilient means acting against the rear end of said stack for urging said stack permanently along said spindle towards a discharge opening in said magazine, and a retaining means protruding into said discharge opening for preventing said stack from being discharged through said opening;

two stationary guide rods, positioned on opposite sides of said magazine, each said guide having a sleeve mounted thereon;

a connecting member attached to one end of each of said sleeves and mounted for a reciprocatory translatory motion on said stationary guide rods, said connecting member forming a support for said magazine;

power means for positively moving said magazine in said reciprocatory translatory motion between a rear retracted position and a forward label stripping position;

a pair of externally profiled camming members mounted one each on the other end of each of said sleeves, said camming members containing a means for axially adjusting said camming members with respect to said sleeves;

means for securing said profiled camming members in adjusted positions;

two frictional members each provided with a respective frictional label engaging element symmetrically located one on either side of said spindle adjacent the discharge opening of said magazine, each of said frictional members being attached to a respective cam follower, each of said cam followers containing a cam detecting portion and being mounted for pivotal movement about a respective stationary pivotal axis, said pivotal axes being symmetrically arranged in relation to the axis of said spindle, said cam detecting surfaces arranged to engage respective camming surfaces on said camming members during said reciprocatory translatory motion of said connecting member and magazine, the precise time of engagement of said cam detecting portions with respective camming surfaces being determined by the adjustment of said camming members with respect to their respective slide sleeves;

said magazine, guide rods, power means, frictional members, cam followers, and camming members arranged such that an initial portion of said reciprocatory translatory motion of said connecting member and magazine provided by said power means causes engagement of said cam detecting portions of said cam followers with said camming surfaces of said camming members to enable said cam followers to move said frictional label engaging elements into a dogging engagement with the exposed surface of the outermost label of said stack, and a further portion of said reciprocatory translatory motion causes said label engaging elements, while maintaining said dogging engagement with said outermost label, to approach each other to a predetermined extent substantially in the plane assumed by said outermost label within said magazine to force said outermost label to slide free of sticking engagement in relation to the next underlying label in said stack and to bulge centrally into a preparatory position for being stripped from said stack of labels through the discharge opening of said magazine.

6. An apparatus as claimed in claim 5, wherein said magazine comprises:

a cup shaped container of circular cross section with an annular closing member containing said retaining means arranged coaxially over the open, forward end of said container, said closing member defining said label discharge opening;

means for detachably securing said closing member in an operative position;

a central bore passing through the bottom of said container for receiving and securing the rear end of said spindle to said container; a rearward projection from said spindle extending through said bottom of said container forming a centering pin for said magazine, and wherein said connecting member contains a seat for loosely accommodating said centering pin.

7. An apparatus as claimed in claim 5, wherein said power means comprises a stationary double-acting pressure medium operated piston-cylinder arrangement, the piston of said arrangement being secured by its outer end to said connecting member; and, wherein an adjustable stop means is provided for defining the retracted position of said connecting member during said reciprocatory translatory motion of said connecting member on said stationary guide rods.

8. An apparatus as claimed in claim 5, further comprising:

a partially hollow bridging member mounted with its ends on said guide rods and secured thereto in a stationary position in front of said discharge opening of said magazine, said stationary pivotal axes of said cam followers being arranged in said hollow bridging member, each of said cam followers being normally biassed to a retracted inoperative position by a spring disposed in the hollow interior of said hollow bridging member in the longitudinal direction thereof, and a bushing means positioned loosely between the adjacent inner ends of said biassing springs and extending centrally through said hollow bridging member and containing therein a through going guide hole for accommodating the forward end of said spindle, the terminal end portion of said spindle tapering in a direction towards said bushing means and the mouth of said guide hole being widened to facilitate introduction of said spindle into said guide hole.

9. An apparatus as claimed in claim 5, wherein said camming members contain an internally threaded socket, said socket being peripherally profiled externally to form said camming surfaces and to provide the same profiled generatrix at all points around its periphery and said cam followers are in the form of a plate provided with cam detecting portions in the form of nodes protruding from the edge of said plate facing a respective camming member.

10. An apparatus as claimed in claim 5, further comprising a pair of such apparatus operating in opposite directions.

11. An apparatus as in claim 6 further comprising suction means for stripping said outermost label from said stack, and means for conveying and delivering each stripped label to a label receiving station.

12. An apparatus as in claim 5 wherein said magazine contains a plate supporting the rear of said stack of labels, said plate containing a centrally disposed protruding bead for imparting a slight arch to said stacked labels.

* * * * *